US009550265B2

(12) United States Patent
Hildebrandt

(10) Patent No.: US 9,550,265 B2
(45) Date of Patent: Jan. 24, 2017

(54) DEVICE AND SYSTEM FOR FINISH-MACHINING A WORKPIECE IN THE FORM OF A CRANKSHAFT OR A CAMSHAFT

(71) Applicant: Supfina Grieshaber GmbH & Co. KG, Wolfach (DE)

(72) Inventor: Oliver Hildebrandt, Hornberg (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 0 days.

(21) Appl. No.: 14/769,103

(22) PCT Filed: Jan. 13, 2014

(86) PCT No.: PCT/EP2014/050499

§ 371 (c)(1),
(2) Date: Aug. 20, 2015

(87) PCT Pub. No.: WO2014/127926

PCT Pub. Date: Aug. 28, 2014

(65) Prior Publication Data

US 2016/0031060 A1 Feb. 4, 2016

(30) Foreign Application Priority Data

Feb. 21, 2013 (EP) ..... 13156079

(51) Int. Cl.
*B24B 21/02* (2006.01)
*B24B 5/42* (2006.01)
(Continued)

(52) U.S. Cl.
CPC ..... *B24B 27/0076* (2013.01); *B24B 5/42* (2013.01); *B24B 19/12* (2013.01); *B24B 21/006* (2013.01);
(Continued)

(58) Field of Classification Search
CPC ..... B24B 35/00; B24B 21/006; B24B 21/008; B24B 21/02; B24B 5/421; B24B 5/42; B24B 19/12; B24B 27/0076
(Continued)

(56) References Cited

U.S. PATENT DOCUMENTS 3,548,546 A * 12/1970 Thielenhaus ..... B24B 5/42 451/163
4,972,631 A * 11/1990 Schwar ..... B24B 41/04 451/124
(Continued)

FOREIGN PATENT DOCUMENTS

| | | | |
|---|---|---|---|
| DE | 4423422 | A1 | 1/1996 |
| DE | 102007059926 | A1 | 6/2009 |
| EP | 12152051 | A1 | 7/2013 |

*Primary Examiner* — Eileen Morgan
(74) *Attorney, Agent, or Firm* — Leydig, Voit & Mayer, Ltd.

(57) ABSTRACT

A device for finish-machining a workpiece in the form of a crankshaft or a camshaft includes a workpiece holder and a rotational drive configured to rotate the workpiece about a workpiece axis. A first finishing tool is configured to machine a main bearing which is concentric with the workpiece axis. A second finishing tool is configured to machine an additional bearing which is radially offset from the workpiece axis. A first tool drive is configured to generate an oscillating movement of the first finishing tool in a direction parallel to the workpiece axis. A second tool drive is configured to generate an oscillating movement of the second finishing tool which is independent of the movement of the first finishing tool in a direction parallel to the workpiece axis.

9 Claims, 2 Drawing Sheets

(51) Int. Cl.
*B24B 19/12* (2006.01)
*B24B 27/00* (2006.01)
*B24B 21/00* (2006.01)
*B24B 35/00* (2006.01)

(52) U.S. Cl.
CPC ..... *B24B 21/008* (2013.01); *B24B 21/02* (2013.01); *B24B 35/00* (2013.01)

(58) Field of Classification Search
USPC ... 451/49, 51, 213, 163, 164, 246, 249, 251, 451/304, 306
See application file for complete search history.

(56) References Cited

U.S. PATENT DOCUMENTS 5,142,827 A * 9/1992 Phillips ..... B24B 21/00 451/57
5,951,377 A * 9/1999 Vaughn ..... B24B 5/42 451/14
5,975,995 A * 11/1999 Hykes ..... B24B 19/12 451/10
6,409,573 B1 * 6/2002 Mukai ..... B24B 5/42 451/11
6,419,563 B1 * 7/2002 Ido ..... B24B 5/42 451/49
6,852,015 B2 * 2/2005 Ito ..... B24B 5/42 451/49
6,878,043 B1 * 4/2005 Junker ..... B24B 5/42 451/249
7,037,173 B2 * 5/2006 Nonoyama ..... B23Q 15/08 451/49
7,269,472 B2 * 9/2007 Ammi ..... B24B 5/04 409/196
8,678,881 B2 * 3/2014 Junker ..... B24B 5/42 451/11
2001/0041523 A1 * 11/2001 Bonachera ..... B24B 5/42 451/307
2004/0166776 A1 * 8/2004 Kondo ..... B24B 5/42 451/28
2009/0142997 A1 * 6/2009 Nagel ..... B24B 5/42 451/306
2013/0189909 A1 7/2013 Hildebrandt et al.

* cited by examiner

DEVICE AND SYSTEM FOR FINISH-MACHINING A WORKPIECE IN THE FORM OF A CRANKSHAFT OR A CAMSHAFT

CROSS-REFERENCE TO PRIOR APPLICATIONS

This application is a U.S. National Stage Application under 35 U.S.C. §371 of International Application No. PCT/EP2014/050499 filed on Jan. 13, 2014, and claims benefit to European Patent Application No. EP 13156079.9 filed on Feb. 21, 2013. The International Application was published in German on Aug. 28, 2014 as WO 2014/127926 A1 under PCT Article 21(2).

FIELD

The invention relates to a device for finish-machining a workpiece in the form of a crankshaft or camshaft, comprising a workpiece holder and a rotational drive for rotating the workpiece about the workpiece axis thereof, comprising a first finishing tool for machining a main bearing which is concentric to the workpiece axis and comprising a second finishing tool for machining an additional bearing which is radially offset from the workpiece axis.

BACKGROUND

DE 44 23 422 A1 discloses a method for externally superfinishing a rotationally symmetrical body, in which method the body is moved in a rotating manner, a finishing tool is moved in an oscillating manner in a direction parallel to the rotational axis and in which a further movement in a direction parallel to the rotational axis is superimposed on the oscillating movement of the finishing tool.

This method is also known under the heading of "finish-machining with superposition stroke" and has the advantage that a profile of a finish-machined workpiece surface is adjustable in a varying manner by a cylindrical shell surface. A slightly convex crankshaft bearing surface, for example, can be produced in this way.

However, the method known from DE 44 23 422 A1 suffers from the disadvantage that in order to set up the finishing device for a crankshaft or camshaft of a particular shape, it requires a relatively high degree of setup complexity. The dimensions, which are relevant to the finish-machining, of workpieces of this type are in particular the diameter and seat width of the main bearings and additional bearings to be machined, the axially parallel distance of the bearings relative to one another and the offset of the additional bearing relative to the workpiece axis.

In motor construction, there is a trend to standardise the dimensions relevant to different motors having different numbers of cylinders and, for example, to select the inside micrometer of the motors (the distance between the cylinder axes) to be identical irrespective of the number of cylinders and also as far as possible to use identical main bearing diameters and seat widths.

SUMMARY

In an embodiment, the present invention provides a device for finish-machining a workpiece in the form of a crankshaft or a camshaft. The device includes a workpiece holder and a rotational drive configured to rotate the workpiece about a workpiece axis of the rotational drive. A first finishing tool is configured to machine a main bearing which is concentric with the workpiece axis. A second finishing tool is configured to machine an additional bearing which is radially offset from the workpiece axis. At least one of a first and second tool drive is configured to generate an oscillating movement of only the first finishing tool or of only the second finishing tool in a direction parallel to the workpiece axis. The first tool drive is configured to generate an oscillating movement of the first finishing tool in a direction parallel to the workpiece axis. The second tool drive is configured to generate an oscillating movement of the second finishing tool which is independent of the movement of the first finishing tool in a direction parallel to the workpiece axis.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
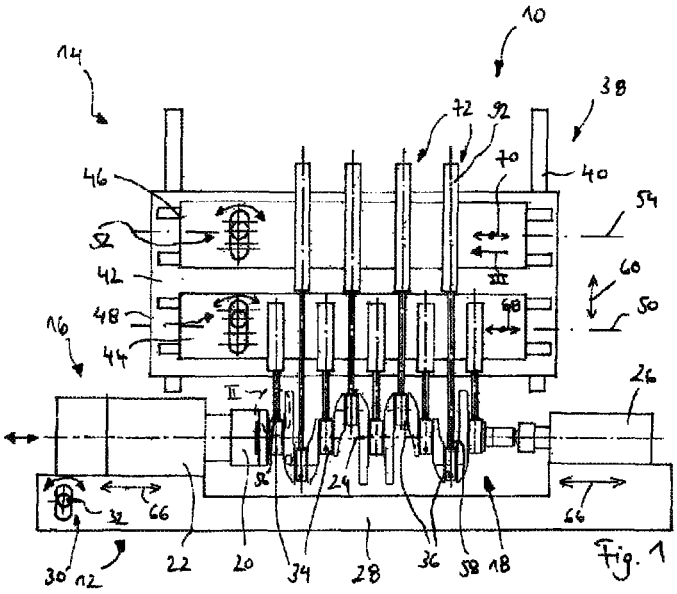
FIG. 1 is a plan view of an embodiment of a device for finish-machining a workpiece.

With regard to attempts to produce a large number of different motors economically, the inventor recognized that it is desirable for the main bearings and big end bearings of a crankshaft and the main bearings and cam faces of a camshaft to also be finish-machined as simply as possible.

On this basis, an embodiment of the present invention provides a device for finish-machining crankshafts or camshafts, by means of which it is possible to simplify the setup for producing crankshafts or camshafts of different shapes.

In an embodiment of the invention at least one tool drive is provided for generating an oscillating movement of only the first finishing tool, or of only the second finishing tool in a direction parallel to the workpiece axis.

According to an embodiment of the invention, the movements of the first finishing tool and of the second finishing tool are uncoupled from one another in a direction parallel to the workpiece axis. For example, a tool drive is provided which sets only the first finishing tool for machining a main bearing or a group of first finishing tools for machining a group of main bearings into a movement oriented in parallel with the workpiece axis. Alternatively or in addition, a tool drive is provided which drives only the second finishing tool for machining an additional bearing (i.e. a big end bearing or a cam face) or a group of second finishing tools for machining a group of additional bearings in a direction parallel to the workpiece axis.

The uncoupling according to an embodiment of the invention of the movement of the first finishing tool and of the second finishing tool allows a flexible machining of different crankshafts which have different main bearing widths and/or big end widths or allows a flexible machining of different camshafts which have different main bearing widths and/or cam face widths. Within the scope of the invention, it is possible to select the finishing tool coupled to a tool drive in respect of the smallest bearing width which is to be produced and to also machine greater bearing widths using a finishing tool of this type in that the tool drive is used to provide an oscillation stroke which runs in parallel with the workpiece axis.

First finishing tools and second finishing tools are preferably arranged in alternation with one another viewed along the workpiece axis, so that the main bearings and additional bearings of a workpiece can be finish-machined in the same clamping setup (i.e. held in the same workpiece holder; preferably in an unchanged position of the workpiece holder).

In a particularly preferred embodiment of the invention, a workpiece drive is provided for generating an oscillating movement of the workpiece in a direction parallel to the workpiece axis. In connection with the at least one tool drive, a superposition stroke can be provided at least for a group of finishing tools (for example for the first finishing tools for machining the main bearings). For the other group of finishing tools (for example for the second finishing tools for machining the additional bearings, for which an individual tool drive is possibly not provided), the workpiece drive can be used for generating a simple oscillating movement of the workpiece (i.e. without a superposition stroke) in a direction parallel to the workpiece axis.

The workpiece drive is preferably configured to generate a higher oscillation frequency and/or a smaller oscillation stroke than the tool drive. Here, it is advantageous that the tool holder and the workpiece form a relatively rigid assembly, compared with the finishing tools, which assembly is better suited to a high-dynamic drive than the finishing tools.

In a particularly preferred embodiment, a first tool drive is provided for generating an oscillating movement of the finishing tool in a direction parallel to the workpiece axis and a second tool drive is provided for generating an oscillating movement, which is independent of the movement of the first finishing tool, of the second finishing tool in a direction parallel to the workpiece axis. As a result, the first finishing tool or a group of first finishing tools and the second finishing tool or a group of second finishing tools can be moved backwards and forwards independently of one another in parallel with the workpiece axis.

When a first tool drive and a second tool drive are used, it is possible to dispense with a workpiece drive for generating an oscillating movement of the workpiece in a direction parallel to the workpiece axis. In this case, the oscillating movement of the finishing tools is provided only by the two tool drives.

A superposition stroke can be provided both for the main bearings and for the additional bearings when two tool drives for generating oscillating mutually independent movements of the first finishing tools and of the second finishing tools are combined with a workpiece drive for generating an oscillating movement of the workpiece in a direction parallel to the workpiece axis. Preferably, in so doing, a relatively high frequency, short-stroke oscillation movement is provided by the workpiece drive and a low frequency, long-stroke oscillation movement is provided by the tool drives. However, alternatively it is also conceivable for a low frequency, long-stroke oscillation movement to be provided by the workpiece drive and for a relatively high frequency, short-stroke oscillation movement to be provided by the tool drives.

When two tool drives are used, it is advantageous for the first tool drive to comprise a first tool holder for holding the first finishing tool and for the second tool drive to comprise a second tool holder for holding the second finishing tool and for the first tool holder and the second tool holder to be mounted on a common frame. The common frame allows a compact arrangement of all the finishing tools, in particular when the first and second finishing tools are arranged alternately.

It is particularly preferred for the position of the first tool holder and/or of the second tool holder to be adjustable on the frame in a direction perpendicular to the workpiece axis. This allows a workpiece holder to be loaded and unloaded in a simple manner.

The first finishing tool and/or the second finishing tool can be a finishing belt or a finishing stone. These finishing tools have an effective width which, in the case of a finishing belt, is determined by the width of the belt and, in the case of a finishing stone, by the width of the stone. To press a finishing belt against a workpiece surface to be machined, what are known as press-on elements or press-on shells are used which are well known from the prior art. Finishing stone holders, which are also well known from the prior art, are used for handling a finishing stone.

An embodiment of the invention also relates to a system for finish-machining workpieces in the form of crankshafts or camshafts, comprising different crankshafts or camshafts having different main bearing widths and/or additional bearing widths.

In an embodiment, a system is provided for finish-machining crankshafts or camshafts, by means of which it is possible to simplify the setup for producing crankshafts or camshafts of different shapes.

An embodiment of the system comprises a device which is described above. The effective width of the first finishing tool is the same as or is less than the smallest main bearing width of the different crankshafts or camshafts and/or in that the effective width of the second finishing tool is the same as or is less than the smallest additional bearing width of the different crankshafts or camshafts.

An embodiment of a device for finish-machining a workpiece is denoted overall in FIG. 1 by reference numeral 10. The device 10 comprises a workpiece region 12 and a tool region 14.

The workpiece region 12 comprises a workpiece holder 16 for holding a workpiece in the form of a crankshaft 18 or camshaft. In the following, an embodiment of the invention is described below on the basis of a workpiece in the form of the crankshaft 18 which has main bearings and additional bearings in the form of big end bearings. However, all configurations apply correspondingly to camshafts which have main bearings concentric to a camshaft axis and additional bearings in the form of cam faces which are radially offset from the camshaft axis.

The workpiece holder 16 comprises for example a headstock 20 having a rotational drive 22 for rotating the crankshaft 18 about the workpiece axis 24 thereof. The workpiece holder 16 further comprises a tailstock 26 which is adjustable along the workpiece axis 24 to be able to clamp crankshafts 18 of different lengths between headstock 20 and tailstock 26.

In a preferred embodiment, the workpiece holder 16, in particular the combination of headstock 20, crankshaft 18 and tailstock 26, is arranged on a support 28 which can be set into an oscillating movement running in parallel with the workpiece axis 24 by a workpiece drive 30. The workpiece drive 30 comprises an eccentric 32, for example.

The crankshaft 18 has a plurality of main bearings 34 which extend concentrically with the workpiece axis 24 and a plurality of big end bearings 36 which are offset eccentrically relative to the workpiece axis 24. The main bearings 34 and big end bearings 36 are arranged in alternation with one another. In the context of the invention, an "alternating arrangement" is also understood as meaning an arrangement in which a plurality of big end bearings 36 are arranged between two main bearings 34 which follow one another in the longitudinal direction of the crankshaft 18.

The tool region 14 comprises a frame 38 having a frame part 40. The frame part 40 is used to guide a tool carrier 42 in a direction perpendicular to the workpiece axis 24.

A first tool holder 44 and a second tool holder 46 are arranged on the tool carrier 42. The tool holders 44, 46 are guided on the tool carrier 42 in parallel with the workpiece axis 24.

A respective tool drive, associated with only one of the tool holders 44, 46, is provided to drive the tool holders 44, 46 in a direction parallel to the workpiece axis 24. A first tool drive 48 (for example in the form of an eccentric) is used to drive the first tool holder 44 along a first tool holder axis 50 which is parallel to the workpiece axis 24. A second tool drive 52 (for example in the form of an eccentric) is used to drive the tool holder 46 along a tool holder axis 54 which is parallel to the workpiece axis 24.

Tool drives 48, 52 in the form of eccentrics have the advantage that it is possible to adjust the oscillation stroke by appropriately controlling a drive of the eccentrics. If, for example, an eccentric is driven by a swivel drive, the oscillation stroke can be adjusted by selecting a swivel angle between 0° and 180°. In the case of swivel angles greater than or equal to 180°, a rotary drive which revolves in one direction can also be used. The oscillation stroke of a tool holder 44, 46 (the distance between the extreme positions) is then equal to double the distance of the eccentrics from the rotary drive axis.

The first tool holder 44 is used to hold a group of first finishing tools 56 which are respectively used for machining a main bearing 34.

The second tool holder 46 is used to arrange a plurality of second finishing tools 58 which are respectively used for machining a big end bearing 36.

The tool carrier 42 can be positioned perpendicularly to the workpiece axis 24 (in directions denoted by reference numeral 60) relative to the frame part 40 to facilitate a loading and unloading procedure of the workpiece holder 16.

The first finishing tools 56 have an effective width 62 measured in parallel with the workpiece axis 24. The effective width 62 is the same as or less than the smallest main bearing width 64 of a plurality of crankshafts 18 having different main bearing widths 64.

An effective width of the second finishing tools 58 is correspondingly the same as or less than the smallest big end bearing width of a plurality of different crankshafts 18.

Mounting devices 72 described in the following can preferably be used to arrange a respective second finishing tool 58 on the second tool holder 46. These mounting devices are also described in detail in EP12152051, filed on 23 Jan. 2012 by the same applicant. In addition to the following description of the mounting devices 72, reference is also made to the content of EP12152051 with regard to the construction and mode of operation of the mounting devices 72.

Mounting device 72 is used to mount a press-on device 74, described in more detail in the following, on the second tool holder 46. A connection portion 76 is provided to connect the mounting device 72 to the second tool holder 46. It is preferred for the relative position between the connection portion 76 and the tool holder 46 to be adjustable in a direction parallel and/or perpendicular to the workpiece axis 24 (for example by appropriate guide means) and, after reaching a desired position of the connection portion 76, for said connection portion to be fixed on the tool holder 46, for example by blocking or jamming the guide means.

The press-on device 74 presses a second finishing tool 58, for example in the form of a finishing belt, against a big end bearing 36 of the crankshaft 18. The finishing belt is guided on a finishing belt guide means 78, for example in the form of a deflection roller 80.

The big end bearing 36 extends concentrically with an additional axis 82 which runs in parallel with and at a distance from the workpiece axis 24 of the crankshaft 18.

While the crankshaft 18 is being machined, it rotates about the workpiece axis 24. In this case, the big end bearing 36 moves in a circle around the workpiece axis 24 corresponding to the distance of the axes 24 and 82.

Since the big end bearing 36 moves in a circle around the workpiece axis 24, as stated above, it is necessary for the finishing tool 58 (optionally together with the finishing band guide means 78) and thereby the press-on device 74 to also be able to follow this movement of the big end bearing 36. For mounting the press-on device 74 on the second tool holder 46, the mounting device 72 therefore has two degrees of freedom which allow a movement of the press-on device 74 in a plane perpendicular to the workpiece axis 24.

The mounting device 72 comprises a swivel part 84 which is held on the connection portion 76 such that it can swivel about a swivel axis 88 by a swivel bearing 86. The swivel axis 88 extends in parallel with the workpiece axis 24.

The swivel part 84 is used to arrange at least one linear guide means 90, by which a mounting part 92 is mounted so as to be moveable along a guide axis 94 of the linear guide means 90 relative to the swivel part 84.

The mounting part 92 extends substantially within a plane extending perpendicularly to the workpiece axis 24. The mounting part 92 has an opening 96 through which the swivel bearing 86 passes.

The mounting part 92 has an end 98, which faces the crankshaft 18, for arranging the press-on device 74.

The press-on device 74 comprises at least one press-on part 100, preferably two press-on parts 100, which is/are configured as tong arms 102, for example. The tong arms 102 can be swiveled about press-on swivel axes 104 relative to the mounting part 92. The press-on swivel axes 104 extend in parallel with the swivel axis 88 of the swivel part 84.

On their end facing the crankshaft 18, the tong arms 102 have press-on elements 106 which are in particular shell shaped so that a finishing tool 58, which is configured as a finishing belt, can be pressed against the big end bearing 36 along part of the periphery of said bearing.

To generate a press-on force, the press-on device 74 comprises a press-on drive 108 which subjects the press-on elements 106 to a press-on force. The press-on drive 108 is configured as a hydraulic unit 110, for example, which subjects the press-on elements 106 to press-on forces 112.

For example, the press-on drive 108 and the press-on elements 106 are arranged on sides of the tong arms 102 which are remote from one another based on the press-on swivel axes 104. In this manner, compressive forces 112 which are remote from one another can be diverted into mutually facing press-on forces 114.

The mounting devices 72 thus form for each of the second finishing tools 58 a swivel/thrust bearing and provides a swiveling and linear movability of the finishing tool 58 relative to the second tool holder 46.

Figure 2:
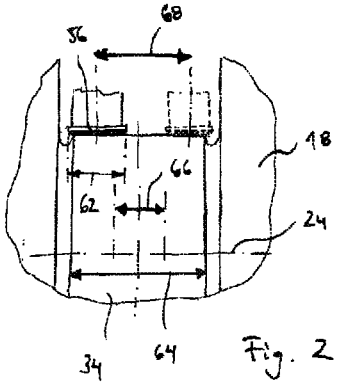
FIG. 2 is an enlarged view of a detail denoted by II in FIG. 1.
Figure 3:
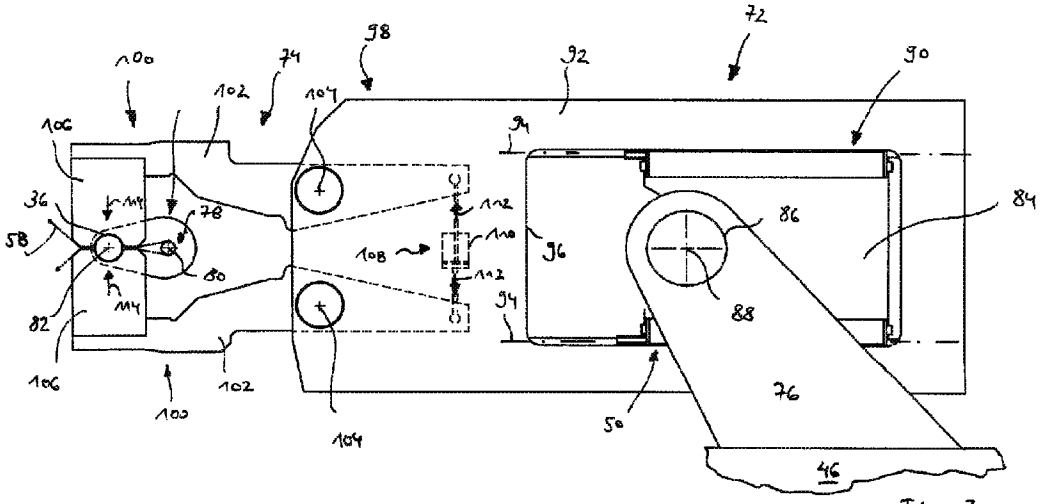
FIG. 3 is a side view of part of the device according to FIG. 1 according to a viewing direction denoted by arrow III in FIG. 1.

In a preferred machining method of the crankshaft 18, said crankshaft is set into an oscillating movement with a first, relatively small oscillation stroke 66 (cf. FIG. 2) by the workpiece drive 30 and the workpiece holder 16. Superimposed on this movement is a superposition stroke 68, generated by the first tool drive 48, of the first finishing tool 56. The superposition stroke 68 is preferably greater than the oscillation stroke 66. Furthermore, it is preferred for the oscillation frequency of the superposition stroke 68 to be less than the oscillation frequency of the oscillation stroke 66.

Independently of the movement of the first finishing tools 56, the second finishing tools 58 are also set into an oscillating movement, indicated by reference numeral 70 in FIG. 1, by the second tool drive 52. In this way, the big end bearings 36 can be machined in one operating cycle or in the same clamping setup independently of the machining of the main bearings 34, a superposition stroke being provided both for the big end bearings 36 and for the main bearings 34.

However, it is also possible to dispense with the workpiece drive 30 and to use only the workpiece drives 48 and 52 to generate mutually independent movements of the first finishing tools 56 and of the second finishing tools 58.

Furthermore, it is also possible to use the workpiece drive 30 to generate an oscillating movement of the crankshaft 18 and to subject only one group of finishing tools, i.e. the first finishing tools 56 or the second finishing tools 58 to a superposition stroke. In this case, it is possible for only a single workpiece drive (48 or 52) to be provided.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A device for finish-machining a workpiece in the form of a crankshaft or a camshaft, the device comprising:

a workpiece holder;

a rotational drive configured to rotate the workpiece about a workpiece axis of the rotational drive;

a first finishing tool configured to machine a main bearing which is concentric with the workpiece axis;

a second finishing tool configured to machine an additional bearing which is radially offset from the workpiece axis; and a first tool drive and a second tool drive, wherein the first tool drive is configured to generate an oscillating movement of the first finishing tool in a direction parallel to the workpiece axis, and wherein the second tool drive is configured to generate an oscillating movement of the second finishing tool in a direction parallel to the workpiece axis, wherein the oscillating movement of the second finishing tool is independent of the oscillating movement of the first finishing tool.

2. The device according to claim 1, wherein the first tool drive is configured to drive a plurality of first finishing tools, or the second tool drive is configured to drive a plurality of second finishing tools, or both.

3. The device according to claim 1, wherein a plurality of first finishing tools and a plurality of second finishing tools are arranged in alteration with one another along the workpiece axis.

4. The device according to claim 1, further comprising a workpiece drive configured to generate an oscillating movement of the workpiece in a direction parallel to the workpiece axis.

5. The device according to claim 4, wherein the workpiece drive is configured to generate at least one of a higher oscillation frequency and a smaller oscillation stroke than the tool drives.

6. The device according to claim 1, wherein the first tool drive comprises a first tool holder for holding the first finishing tool and the second tool drive comprises a second tool holder for holding the second finishing tool, and wherein the first tool holder and the second tool holder are mounted on a common frame.

7. The device according to claim 6, wherein a position of at least one of the first tool holder and the second tool holder is adjustable on the frame in a direction perpendicular to the workpiece axis.

8. The device according to claim 1, wherein at least one of the first finishing tool and the second finishing tool is a finishing belt or a finishing stone.

9. A system for finish-machining workpieces in the form of crankshafts or camshafts, the system comprising:

different crankshafts or camshafts having different main bearing widths, or additional bearing widths, or both;

a workpiece holder;

a rotational drive configured to rotate the workpiece about a workpiece axis of the rotational drive;

a first finishing tool configured to machine a main bearing which is concentric with the workpiece axis;

a second finishing tool configured to machine an additional bearing which is radially offset from the workpiece axis; and a first tool drive and a second tool drive, wherein the first tool drive is configured to generate an oscillating movement of the first finishing tool in a direction parallel to the workpiece axis, and wherein the second tool drive is configured to generate an oscillating movement of the second finishing tool in a direction parallel to the workpiece axis, wherein the oscillating movement of the second finishing tool is independent of the oscillating movement of the first finishing tool, and wherein an effective width of the first finishing tool is the same as or is less than a smallest main bearing width of the different crankshafts or camshafts, or an effective width of the second finishing tool is the same as or is less than a smallest additional bearing width of the different crankshafts or camshafts, or both.

* * * * *